US011370089B2

(12) United States Patent
Lee

(10) Patent No.: US 11,370,089 B2
(45) Date of Patent: Jun. 28, 2022

(54) RATCHET WRENCH

(71) Applicant: Tsan-Chang Lee, Taichung (TW)

(72) Inventor: Tsan-Chang Lee, Taichung (TW)

( * ) Notice: Subject to any disclaimer, the term of this patent is extended or adjusted under 35 U.S.C. 154(b) by 60 days.

(21) Appl. No.: 16/866,642

(22) Filed: May 5, 2020

(65) Prior Publication Data

US 2021/0347017 A1 Nov. 11, 2021

(51) Int. Cl.
*B25B 13/46* (2006.01)

(52) U.S. Cl.
CPC ..... *B25B 13/463* (2013.01)

(58) Field of Classification Search
CPC ..... B23B 23/0007; B25B 13/463
USPC ..... 81/60, 61, 62, 63, 63.1, 63.2
See application file for complete search history.

(56) References Cited

U.S. PATENT DOCUMENTS 6,711,973 B2 * 3/2004 Arnold ..... B25B 23/0035 81/63
6,971,287 B2 * 12/2005 Lee ..... B25B 13/463 81/60
9,114,510 B2 8/2015 Lee et al.
2005/0155463 A1 * 7/2005 Shu-Sui ..... B25B 13/463 81/63.2
2014/0020518 A1 * 1/2014 Huang ..... B25B 17/02 81/63.1
2014/0083259 A1 * 3/2014 Anderson ..... B25B 13/463 81/63.1
2017/0361430 A1 * 12/2017 Mitcheltree ..... B25B 13/468
2018/0015595 A1 * 1/2018 Lai ..... B25B 13/463
2018/0200870 A1 * 7/2018 Shih ..... B21D 53/36
2018/0272504 A1 * 9/2018 Yang ..... B25B 13/463
2021/0094154 A1 * 4/2021 Wypych ..... B25B 13/463

* cited by examiner

*Primary Examiner* — Joseph J Hail
*Assistant Examiner* — Robert C Moore
(74) *Attorney, Agent, or Firm* — Karin L. Williams; Alan D. Kamrath; Mayer & Williams PC

(57) ABSTRACT

A ratchet wrench includes a main body, a ratchet wheel, a pawl member, and a direction control unit. The main body is provided with a first receiving recess, a second receiving recess, a third receiving recess, a first abutting face, and a second abutting face. The pawl member is provided with an engaging portion, a cavity, two first abutting portions, and two corners. The direction control unit includes a rotation member, a push member, and an elastic member. The rotation member is provided with a cylindrical block, and two second abutting portions. The push member is provided with a push face and a receiving space. The push member is restricted by the first abutting face and restricts the rotation member such that the rotation member is mounted in and will not be detached from the third receiving recess.

9 Claims, 9 Drawing Sheets

RATCHET WRENCH

BACKGROUND OF THE INVENTION

1. Field of the Invention

The present invention relates to a hand tool and, more particularly, to a ratchet wrench.

2. Description of the Related Art

A conventional ratchet wrench was disclosed in the applicant's U.S. Pat. No. 9,114,510, and comprises a body 10 which has a first space 11, a second space 12, and a third space 13. A ratchet wheel 20 is rotatably located in the first space 11 and has driving teeth 21 defined in outside thereof. A pawl 30 is located in one side of the second space 12 and movable in the second space 12. The pawl 30 has a first recess 32 and two second recesses 33. The pawl 30 has engaging teeth 31 engaged with the driving teeth 21 of the ratchet wheel 20. A switch unit 40 is located in the third space 13 so as to control movement of the pawl 30 in the second space 12. The switch unit 40 has a switch member 41, an end piece 42, a first resilient member 43, a bead 44 and a first clip 45.

However, the conventional ratchet wrench has the following disadvantages.

1. The end piece 42 and the first recess 32 only have a linear contact therebetween, such that the end piece 42 and the first recess 32 are not connected exactly and steadily. Besides, the end piece 42 does not have a positioning effect.

2. The pawl 30 is received in the second space 12. The end piece 42 is pushed by the first resilient member 43 to abut the first recess 32, such that the engaging teeth 31 engage the driving teeth 21. The switch unit 40 is rotated to drive the pawl 30 such that the pawl 30 is moved in the second space 12 to control rotation of the ratchet wheel 20. The switch member 41 is mounted in the third space 13 by the first clip 45. The first clip 45 is easily loosened from the third space 13 during a long-term utilization, such that the switch member 41 is removed from the body 10.

3. The first resilient member 43 is received in the end piece 42 which has a thin shell structure. Thus, when the switch member 41 is rotated, the end piece 42 easily hits the wall of the second space 12, such that the end piece 42 easily damaged.

BRIEF SUMMARY OF THE INVENTION

In accordance with the present invention, there is provided a ratchet wrench comprising a main body, a ratchet wheel, a pawl member, and a direction control unit. The main body is provided with a first receiving recess, a second receiving recess, a third receiving recess, a first abutting face, a second abutting face, a first pivot portion, and a depression. The ratchet wheel is provided with a mounting portion and a ratchet portion. The pawl member is provided with an engaging portion, a cavity, a first face, two second faces, two first abutting portions, and two corners. The direction control unit includes a rotation member, a push member, and an elastic member. The rotation member is provided with a cylindrical block, a receiving chamber, two second abutting portions, and a second pivot portion. The push member is provided with a push face and a receiving space. The push member is restricted by the first abutting face. The push member restricts the rotation member such that the rotation member is mounted in and will not be detached from the third receiving recess.

According to the primary advantage of the present invention, when the rotation member is rotated, the push face enters the respective second face automatically, such that the rotation member and the push member have an automatically positioning function. The two corners restrict the push member to prevent the push member from being detached from the cavity. The push member has a cuboid shape such that the push face and each of the two second faces have a larger contact area. The contact area of the push face 421 and each of the two second faces extends in the height direction of the pawl member, such that the push member presses the pawl member efficiently.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 2:
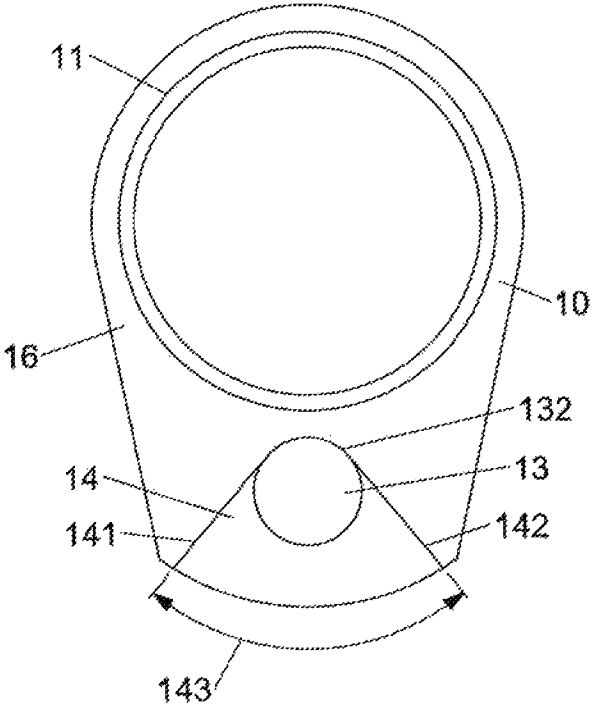
FIG. 2 is a top view of a main body of the ratchet wrench in accordance with the preferred embodiment of the present invention.
Figure 1:
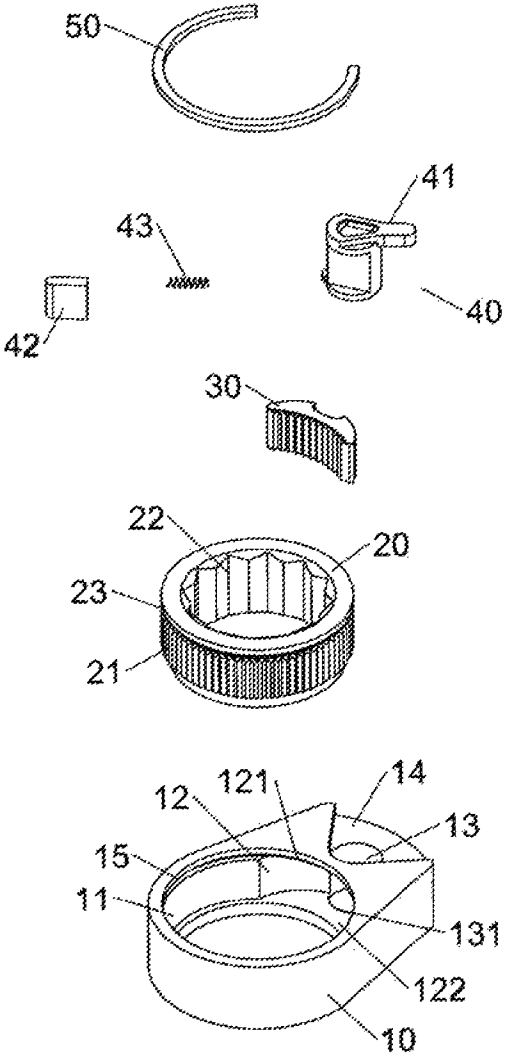
FIG. 1 is an exploded perspective view of a ratchet wrench in accordance with the preferred embodiment of the present invention.
Figure 4:
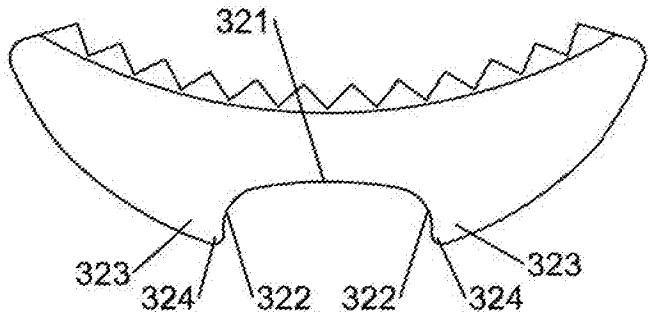
FIG. 4 is a top view of the pawl member as shown in FIG. 3.
Figure 3:
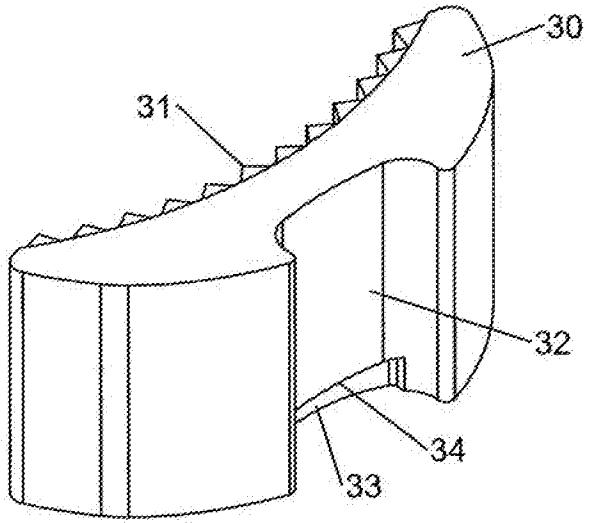
FIG. 3 is a perspective view of a pawl member of the ratchet wrench in accordance with the preferred embodiment of the present invention.
Figure 6:
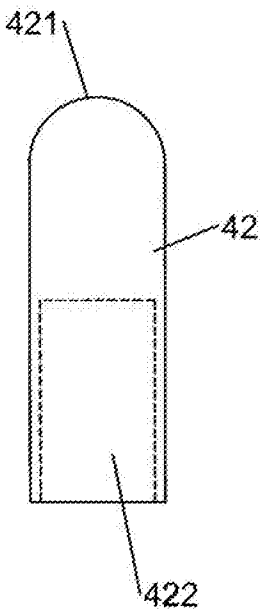
FIG. 6 is a planar view of a push member of the ratchet wrench in accordance with the preferred embodiment of the present invention.
Figure 5:
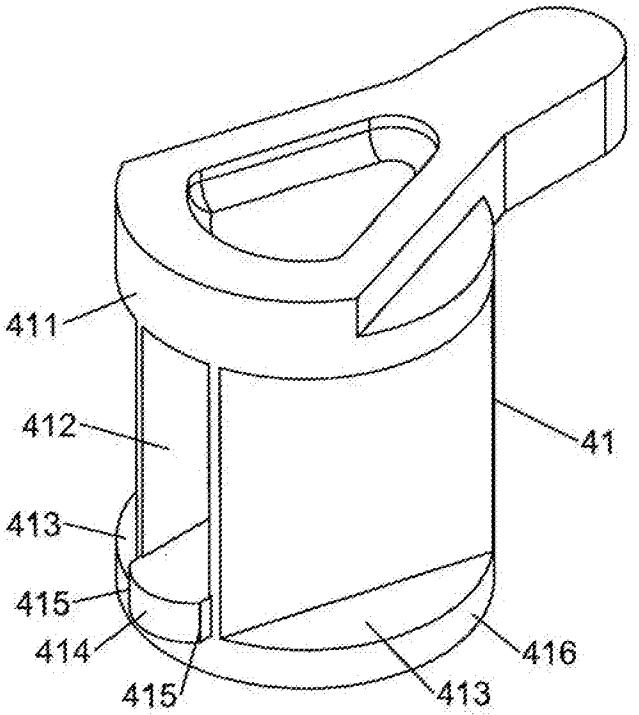
FIG. 5 is a perspective view of a rotation member of the ratchet wrench in accordance with the preferred embodiment of the present invention.
Figure 7:
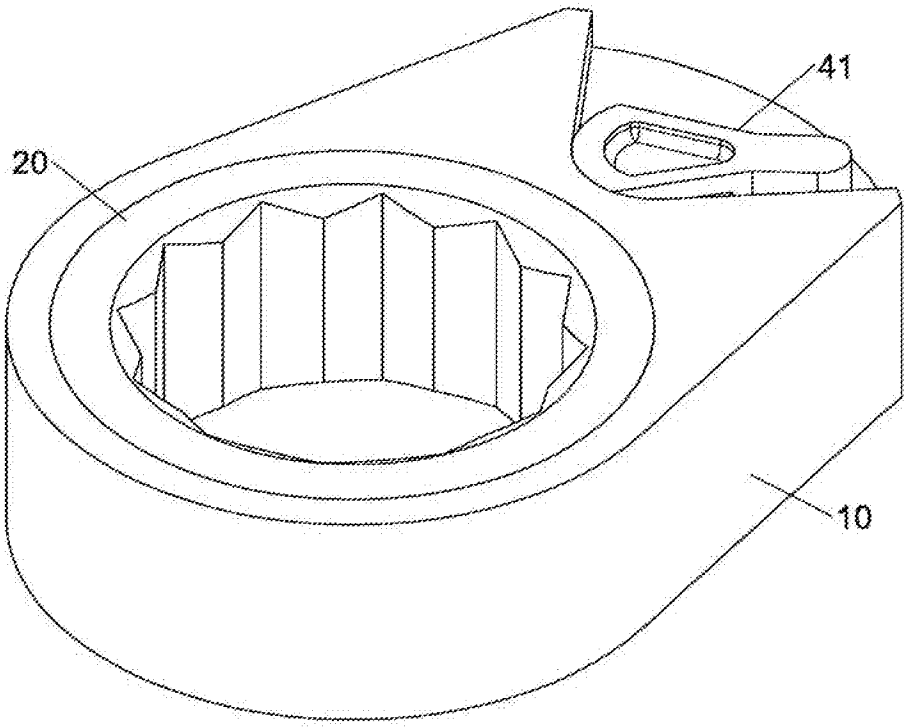
FIG. 7 is a perspective view of the ratchet wrench in accordance with the preferred embodiment of the present invention.
Figure 9:
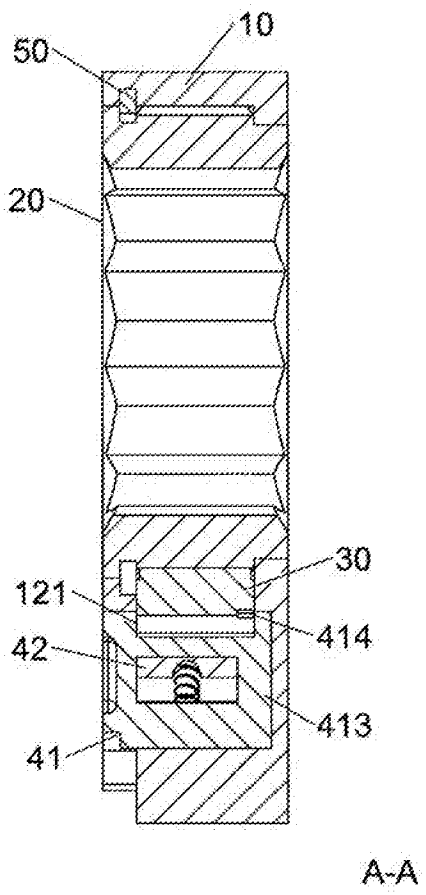
FIG. 9 is a cross-sectional view of the ratchet wrench taken along line A-A as shown in FIG. 8.
Figure 8:
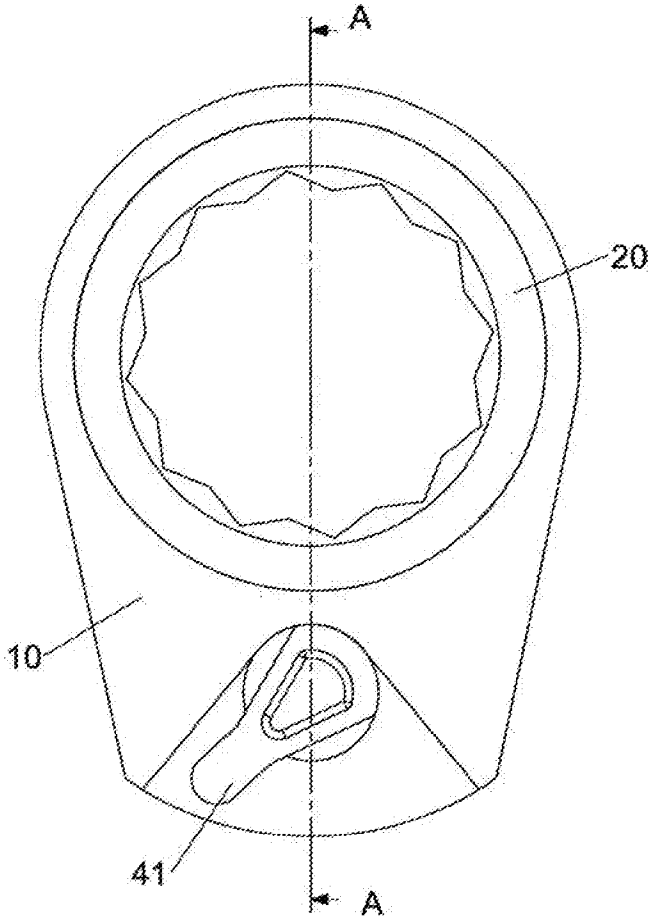
FIG. 8 is a top view of the ratchet wrench as shown in FIG. 7.

Referring to the drawings and initially to FIGS. 1-7, a ratchet wrench in accordance with the preferred embodiment of the present invention comprises a main body 10, a ratchet wheel 20, a pawl member 30, a direction control unit 40, and a retaining ring 50.

The main body 10 is provided with a first receiving recess 11 which has a circular shape and penetrates the main body 10. The main body 10 is provided with a second receiving recess 12 connected to the first receiving recess 11. The second receiving recess 12 has a diameter smaller than that of the first receiving recess 11 and has a center located in the first receiving recess 11. The second receiving recess 12 has a closed top provided with a first abutting face 121 and a closed bottom provided with a second abutting face 122. The main body 10 is provided with a third receiving recess 13 connected to the second receiving recess 12. The third receiving recess 13 has an open top. The third receiving recess 13 has a depth greater than that of the second receiving recess 12, a first pivot portion 131 is formed between the second receiving recess 12 and the third receiving recess 13. The main body 10 is provided with a circular portion 132 which has a center coinciding with that of the third receiving recess 13. The main body 10 is provided with a depression 14 connected to the third receiving recess 13. The third receiving recess 13 has an opening located in the depression 14. The depression 14 is provided with a first resting face 141 and a second resting face 142. Each of the first resting face 141 and the second resting face 142 has a planar shape and is tangent to the circular portion 132. The main body 10 is provided with a first annular groove 15 connected to the first receiving recess 11. The main body 10 has a top provided with an end face 16 having a planar shape.

The ratchet wheel 20 is pivotally mounted in the first receiving recess 11 and is provided with a mounting portion 22. The ratchet wheel 20 has a periphery provided with a ratchet (or toothed) portion 21 having an annular shape. The ratchet portion 21 is provided with a second annular groove 23 aligning with the first annular groove 15.

The pawl member 30 is received in the second receiving recess 12, and rests on the first abutting face 121 and the second abutting face 122. The pawl member 30 has a front side provided with an engaging portion 31 engaging the ratchet portion 21 and a rear provided with a cavity 32 having an arcuate shape. The cavity 32 has a U-shaped configuration and has a first face 321 and two second faces 322. The first face 321 is a concave face and is arranged at a middle of the cavity 32. The first face 321 has a single arcuate shape with a diameter. The two second faces 322 are arranged symmetrically at two sides of the first face 321. Each of the two second faces 322 is a concave face and is tangent to the first face 321. Each of the two second faces 322 has a single arcuate shape with a diameter smaller than that of the first face 321. The cavity 32 has two corners 324. Each of the two second faces 322 is located between the first face 321 and each of the two corners 324. The rear side of the pawl member 30 is provided with two first abutting portions 323 arranged symmetrically relative to the cavity 32. The cavity 32 is arranged between the two first abutting portions 323. The pawl member 30 is provided with a limit channel 33 connected to the cavity 32. The limit channel 33 faces the second abutting face 122. The limit channel 33 has a depth greater than that of the cavity 32, and a limit face 34 is formed between the cavity 32 and the limit channel 33. The limit face 34 has a planar shape.

The direction control unit 40 is pivotally mounted in the third receiving recess 13, and is rotated to move the pawl member 30 leftward and rightward in the second receiving recess 12, so as to control rotation of the ratchet wheel 20. The direction control unit 40 includes a rotation (swivel or turning) member 41, a push member 42, and an elastic member 43.

The rotation member 41 is pivotally mounted in the third receiving recess 13, and has a first end provided with a cylindrical block 411 and a second end provided with a second pivot portion 416. The cylindrical block 411 extends into the depression 14, and has a surface flush with the end face 16. The cylindrical block 411 is provided with a drive knob arranged between the first resting face 141 and the second resting face 142. The second pivot portion 416 is pivotally mounted on the first pivot portion 131. The rotation member 41 is provided with two second abutting portions 413 abutting the two first abutting portions 323 and the two corners 324 respectively. The rotation member 41 is provided with a receiving chamber 412. The receiving chamber 412 has a rectangular shape and has an opening facing the cavity 32. The receiving chamber 412 has a bottom provided with a projection 414 extending into the second receiving recess 12. When the rotation member 41 is moved to a position (or middle position), the projection 414 is received in the limit channel 33 and restricted by the limit face 34. The projection 414 has a width greater than that of the receiving chamber 412 and is provided with two third abutting portions 415 abutting a wall of the second receiving recess 12, such that rotation of the rotation member 41 is limited by the projection 414, to prevent an excessive rotation of the rotation member 41 in the third receiving recess 13. Thus, the projection 414 restricts the maximum rotation angle of the rotation member 41.

The push member 42 has a shape corresponding to that of the receiving chamber 412 and has a cuboid shape. The push member 42 is partially received in the receiving chamber 412 and has a first end provided with a push face 421 and a second end provided with a receiving space 422. The push face 421 is received in the cavity 32 and has a single arcuate shape with a diameter equal to that of each of the two second faces 322. The rotation member 41 is rotated, to control the push member 42 and the pawl member 30, such that the push face 421 is moved to press one of the two second faces 322, and the pawl member 30 is moved in the second receiving recess 12. When the push face 421 rests on one of the two second faces 322, the push member 42 is restricted by one of the two corners 324, thereby preventing the push member 42 from being detached from the cavity 32. The receiving space 422 has a circular shape and has an opening facing and connected to the receiving chamber 412.

The elastic member 43 is received in the receiving chamber 412 and the receiving space 422, and biased between the rotation member 41 and the push member 42, to push the push member 42 toward the pawl member 30, such that the push face 421 presses the cavity 32.

The push member 42 partially extends into the second receiving recess 12, and is restricted by the first abutting face 121. The push member 42 restricts the rotation member 41, thereby limiting and preventing the rotation member 41 from being detached from the third receiving recess 13.

When the rotation member 41 is moved to a position where the pawl member 30 rests on a peripheral wall of the second receiving recess 12, one of the two first abutting portions 323 restricts one of the two second abutting portions 413 (see FIG. 12), thereby limiting and preventing the rotation member 41 from being detached from the third receiving recess 13, and thereby preventing the direction control unit 40 from being detached from the main body 10. At this time, the projection 414 is detached from the limit face 34.

When the rotation member 41 is moved to a position where the pawl member 30 is located at a middle position of the second receiving recess 12, the two corners 324 restrict the two second abutting portions 413 (see FIG. 13), thereby limiting and preventing the rotation member 41 from being detached from the third receiving recess 13. At this time, the projection 414 rests on the limit face 34, such that the rotation member 41 is pivotally mounted in the third receiving recess 13.

The retaining ring 50 is mounted in the first annular groove 15 and the second annular groove 23, such that the ratchet wheel 20 is retained in the first receiving recess 11 by the retaining ring 50. Preferably, the retaining ring 50 has a C-shaped profile.

In the preferred embodiment of the present invention, an angle 143 is defined between the circular portion 132, the first resting face 141, and the second resting face 142, and is ranged between sixty and one hundred degrees (60-100°). The angle 143 is optimally ranged between seventy and ninety degrees (70-90°).

In the preferred embodiment of the present invention, the mounting portion 22 is a polygonal hole. Alternatively, the mounting portion 22 is a square head.

In the preferred embodiment of the present invention, the elastic member 43 is a spring.

Referring to FIGS. 1-9, the ratchet wheel 20 is pivotally mounted in the first receiving recess 11, the pawl member 30 is received in the second receiving recess 12, and the direction control unit 40 is pivotally mounted in the third receiving recess 13 and the depression 14. The second pivot portion 416 is pivotally mounted on the first pivot portion 131. The direction control unit 40 is rotated to move the pawl member 30 leftward and rightward in the second receiving recess 12, so as to control a two-directional rotation of the ratchet wheel 20. The retaining ring 50 is mounted in the first annular groove 15 and the second annular groove 23, such that the ratchet wheel 20 is retained in the first receiving recess 11.

Figure 11:
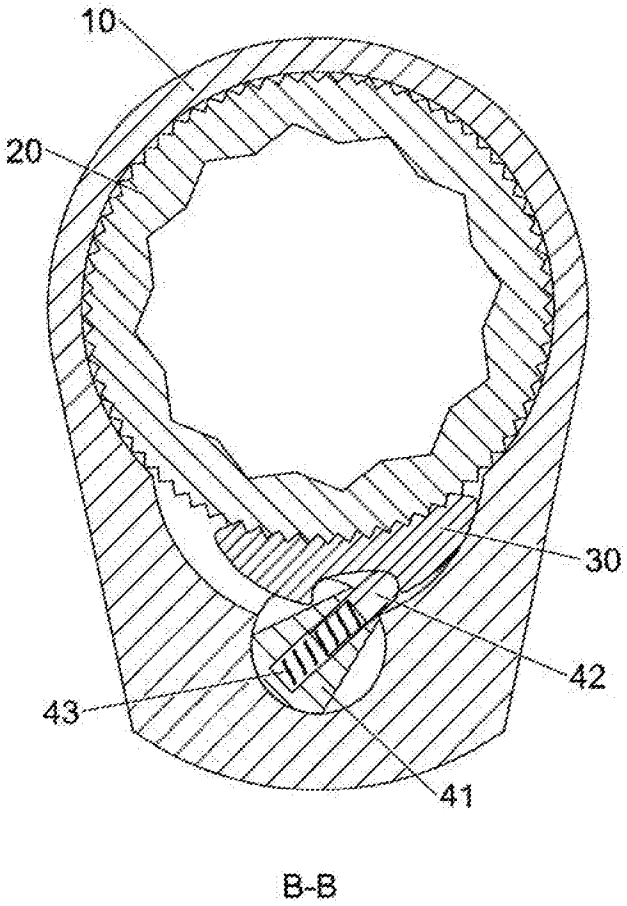
FIG. 11 is a cross-sectional view of the ratchet wrench taken along line B-B as shown in FIG. 10.
Figure 10:
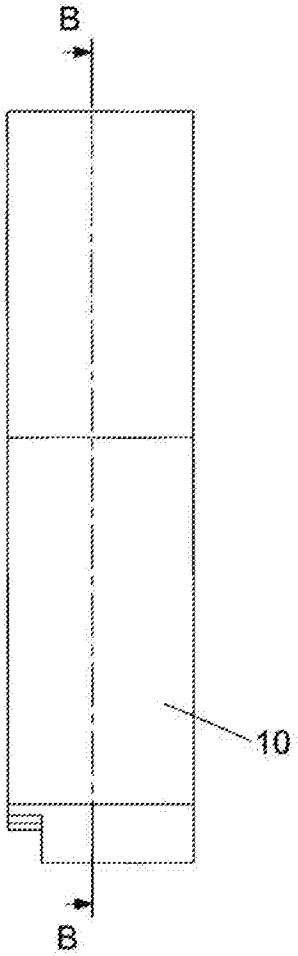
FIG. 10 is a side view of the ratchet wrench in accordance with the preferred embodiment of the present invention.
Figure 12:
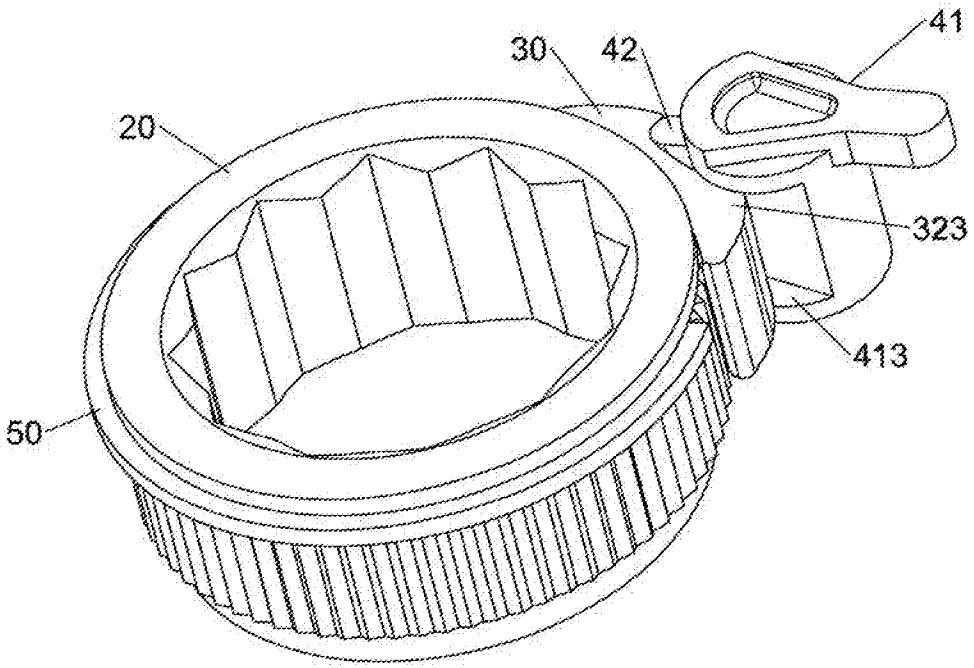
FIG. 12 is a partial perspective view of the ratchet wrench as shown in FIG. 7.

Referring to FIGS. 10-12 with reference to FIGS. 1-9, when the rotation member 41 is moved to a position where one end of the pawl member 30 rests on the peripheral wall of the second receiving recess 12, the bottom of one of the two first abutting portions 323 rests on one of the two second abutting portions 413, thereby limiting and preventing the rotation member 41 from being detached from the third receiving recess 13. At this time, the projection 414 extends into the second receiving recess 12, and one of the two third abutting portions 415 rests on the wall of the second receiving recess 12. Thus, the projection 414 restricts the maximum rotation angle of the rotation member 41. The elastic member 43 pushes the push member 42 toward the pawl member 30, such that the push face 421 rests on one of the two second faces 322. Thus, the direction control unit 40 is rotated to move the pawl member 30 leftward and rightward in the second receiving recess 12.

Figure 13:
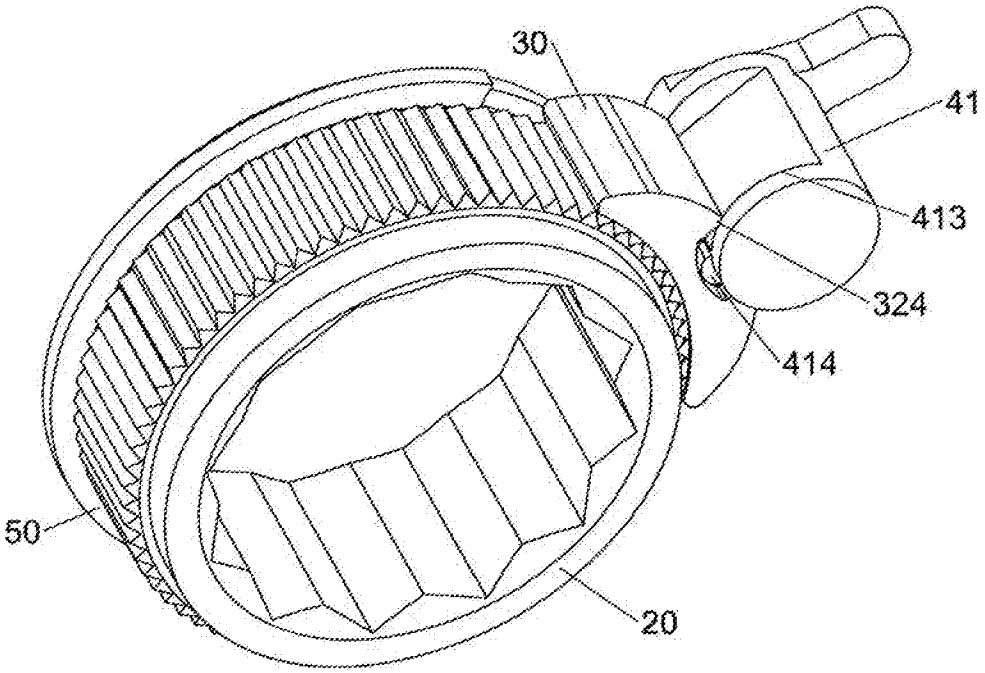
FIG. 13 is a schematic operational view of the ratchet wrench as shown in FIG. 12.
Figure 14:
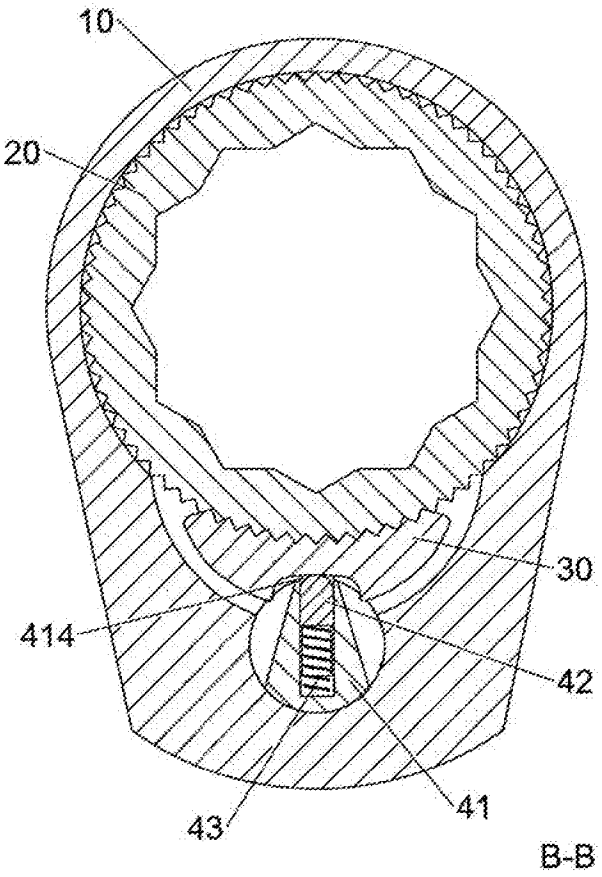
FIG. 14 is a schematic operational view of the ratchet wrench as shown in FIG. 11.

Referring to FIGS. 13 and 14 with reference to FIGS. 1-6, when the rotation member 41 is rotated and moved to a position where the pawl member 30 is located at a middle position of the second receiving recess 12, the two ends of the pawl member 30 are detached and spaced from the peripheral wall of the second receiving recess 12. At this time, the bottom of each of the two corners 324 rests on each of the two second abutting portions 413, and the projection 414 rests on the limit face 34, thereby limiting and preventing the rotation member 41 from being detached from the third receiving recess 13. Thus, the rotation member 41 is restricted by the two corners 324 and the limit face 34, such that the rotation member 41 will not be detached from the main body 10 and the pawl member 30. In addition, the push face 421 presses the first face 321.

Accordingly, the ratchet wrench has the following advantages.

1. The diameter of the push face 421 is equal to that of each of the two second faces 322, such that when the push member 42 is pushed by the elastic member 43, and the push face 421 is moved to press one of the two second faces 322, the push face 421 is received the respective second face 322. Thus, when the rotation member 41 is rotated, the push face 421 enters the respective second face 322 automatically, such that the rotation member 41 and the push member 42 have an automatically positioning function.

2. The two corners 324 restrict the push member 42 to prevent the push member 42 from being detached from the cavity 32. Thus, the two corners 324 limit the maximum rotation angle of the push member 42.

3. The push member 42 has a cuboid shape such that the push face 421 and each of the two second faces 322 have a larger contact area. The contact area of the push face 421 and each of the two second faces 322 extends in the height direction of the pawl member 30, such that the push member 42 presses the pawl member 30 efficiently.

4. The push member 42 has a cuboid shape and only has the receiving space 422 such that the push member 42 has a larger volume and an enhanced structural strength.

5. When one end of the pawl member 30 rests on the peripheral wall of the second receiving recess 12, the push member 42 is restricted by the first abutting face 121, and the rotation member 41 is restricted by the push member 42. In addition, the bottom of one of the two first abutting portions 323 rests on one of the two second abutting portions 413. Thus, the rotation member 41 is restricted by the first abutting face 121 and the two first abutting portions 323, such that the main body 10 and the pawl member 30 restrict the rotation member 41, to prevent the rotation member 41 from being detached from the third receiving recess 13.

6. When the pawl member 30 is located at the middle position of the second receiving recess 12, the push member 42 is restricted by the first abutting face 121, and the rotation member 41 is restricted by the push member 42. In addition, the bottom of each of the two corners 324 rests on each of the two second abutting portions 413, and the projection 414 rests on the limit face 34. Thus, the rotation member 41 is restricted by the first abutting face 121, the two corners 324, and the limit face 34, such that the rotation member 41 will not be detached from the third receiving recess 13.

7. The rotation member 41 is restricted by the main body 10 and the pawl member 30, such that the rotation member 41 is mounted in the third receiving recess 13 exactly and steadily.

8. The projection 414 extends into the second receiving recess 12, with one of the two third abutting portions 415 located adjacent to one end of the second receiving recess 12. When the rotation member 41 is rotated, the other one of the two third abutting portions 415 is located adjacent to the other end of the second receiving recess 12. Thus, the rotation member 41 is restricted by the projection 414, such that the projection 414 limits the maximum rotation angle of the rotation member 41, thereby preventing the push member 42 from hitting the second receiving recess 12.

9. The direction control unit 40 is pivotally mounted in the third receiving recess 13. The cylindrical block 411 is provided with a drive knob extending into the depression 14 and arranged between the first resting face 141 and the second resting face 142. When the rotation member 41 is rotated, the drive knob is moved to the first resting face 141 or the second resting face 142. Thus, the first resting face 141 and the second resting face 142 also limit the rotation angle of the rotation member 41.

10. The second pivot portion 416 is pivotally mounted on the first pivot portion 131, such that the rotation member 41 is mounted in the third receiving recess 13 exactly.

11. The rotation member 41 is pivotally mounted in the third receiving recess 13, and the cylindrical block 411 is received in the depression 14 and has a surface flush with the end face 16, to prevent the user from touching and rotating the rotation member 41 inadvertently when operating the ratchet wrench.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A ratchet wrench comprising:

a main body, a ratchet wheel, a pawl member, a direction control unit, and a retaining ring;

wherein:

the main body is provided with a first receiving recess which has a circular shape;

the main body is provided with a second receiving recess connected to the first receiving recess;

the second receiving recess has a diameter smaller than that of the first receiving recess;

the second receiving recess has a top provided with a first abutting face and a bottom provided with a second abutting face;

the main body is provided with a third receiving recess connected to the second receiving recess;

the third receiving recess has a depth greater than that of the second receiving recess;

a first pivot portion is formed between the second receiving recess and the third receiving recess;

the main body is provided with a circular portion which has a center coinciding with that of the third receiving recess;

the main body is provided with a depression connected to the third receiving recess;

the depression is provided with a first resting face and a second resting face;

each of the first resting face and the second resting face has a planar shape and is tangent to the circular portion;

the main body is provided with a first annular groove connected to the first receiving recess;

the main body has a top provided with an end face having a planar shape;

the ratchet wheel is pivotally mounted in the first receiving recess and is provided with a mounting portion;

the ratchet wheel has a periphery provided with a ratchet portion having an annular shape;

the ratchet portion is provided with a second annular groove aligning with the first annular groove;

the pawl member is received in the second receiving recess, and rests on the first abutting face and the second abutting face;

the pawl member has a front side provided with an engaging portion engaging the ratchet portion and a rear provided with a cavity;

the cavity has a U-shaped configuration and has a first face and two second faces;

the first face is a concave face;

the first face has a single arcuate shape with a diameter;

the two second faces are arranged at two sides of the first face;

each of the two second faces is a concave face and is tangent to the first face;

each of the two second faces has a single arcuate shape with a diameter smaller than that of the first face;

the cavity has two corners;

each of the two second faces is located between the first face and each of the two corners;

the rear side of the pawl member is provided with two first abutting portions;

the cavity is arranged between the two first abutting portions;

the pawl member is provided with a limit channel connected to the cavity;

the limit channel faces the second abutting face;

the limit channel has a depth greater than that of the cavity;

a limit face is formed between the cavity and the limit channel;

the limit face has a planar shape;

the direction control unit is pivotally mounted in the third receiving recess, and is rotated to move the pawl member in the second receiving recess;

the direction control unit includes a rotation member, a push member, and an elastic member;

the rotation member is pivotally mounted in the third receiving recess, and has a first end provided with a cylindrical block and a second end provided with a second pivot portion;

the cylindrical block extends into the depression, and has a surface flush with the end face;

the cylindrical block is provided with a drive knob arranged between the first resting face and the second resting face and movable to rest on one of the first resting face and the second resting face;

the second pivot portion is pivotally mounted on the first pivot portion;

the rotation member is provided with two second abutting portions abutting the two first abutting portions and the two corners respectively;

the rotation member is provided with a receiving chamber having a rectangular shape;

the receiving chamber has a bottom provided with a projection extending into the second receiving recess;

the projection has a height more than that of each of the two second abutting portions;

when the rotation member is moved to a position, the projection is received in the limit channel and restricted by the limit face;

the projection has a width greater than that of the receiving chamber and is provided with two third abutting portions abutting a wall of the second receiving recess;

the push member has a cuboid shape;

the push member is partially received in the receiving chamber and has a first end provided with a push face and a second end provided with a receiving space;

the push face is received in the cavity and has a single arcuate shape with a diameter equal to that of each of the two second faces;

the push face is moved to press one of the two second faces, and the pawl member is moved in the second receiving recess;

when the push face rests on one of the two second faces, the push member is restricted by one of the two corners;

the elastic member is received in the receiving chamber and the receiving space, and biased between the rotation member and the push member;

the push member partially extends into the second receiving recess, and is restricted by the first abutting face;

the push member restricts the rotation member;

when the pawl member rests on a peripheral wall of the second receiving recess, one of the two first abutting portions restricts one of the two second abutting portions;

when the pawl member is located at a middle position of the second receiving recess, the two corners restrict the two second abutting portions; and the retaining ring is mounted in the first annular groove and the second annular groove.

2. The ratchet wrench as claimed in claim 1, wherein:

an angle is defined between the circular portion, the first resting face, and the second resting face, and is ranged between sixty and one hundred degrees.

3. The ratchet wrench as claimed in claim 1, wherein the mounting portion is a polygonal hole.

4. The ratchet wrench as claimed in claim 1, wherein the elastic member is a spring.

5. The ratchet wrench as claimed in claim 1, wherein the two second abutting portions are located under the two first abutting portions and the two corners respectively.

6. The ratchet wrench as claimed in claim 1, wherein the circular portion is enclosed in the depression.

7. A ratchet wrench comprising:

a main body, a ratchet wheel, a pawl member, a direction control unit, and a retaining ring;

wherein:

the main body is provided with a first receiving recess which has a circular shape;

the main body is provided with a second receiving recess connected to the first receiving recess;

the second receiving recess has a diameter smaller than that of the first receiving recess;

the second receiving recess has a top provided with a first abutting face and a bottom provided with a second abutting face;

the main body is provided with a third receiving recess connected to the second receiving recess;

the third receiving recess has a depth greater than that of the second receiving recess;

a first pivot portion is formed between the second receiving recess and the third receiving recess;

the main body is provided with a circular portion which has a center coinciding with that of the third receiving recess;

the main body is provided with a depression connected to the third receiving recess;

the depression is provided with a first resting face and a second resting face;

each of the first resting face and the second resting face has a planar shape and is tangent to the circular portion;

the main body is provided with a first annular groove connected to the first receiving recess;

the main body has a top provided with an end face having a planar shape;

the ratchet wheel is pivotally mounted in the first receiving recess and is provided with a mounting portion;

the ratchet wheel has a periphery provided with a ratchet portion having an annular shape;

the ratchet portion is provided with a second annular groove aligning with the first annular groove;

the pawl member is received in the second receiving recess, and rests on the first abutting face and the second abutting face;

the pawl member has a front side provided with an engaging portion engaging the ratchet portion and a rear provided with a cavity;

the cavity has a U-shaped configuration and has a first face and two second faces;

the first face is a concave face;

the first face has a single arcuate shape with a diameter;

the two second faces are arranged at two sides of the first face;

each of the two second faces is a concave face and is tangent to the first face;

each of the two second faces has a single arcuate shape with a diameter smaller than that of the first face;

the cavity has two corners;

each of the two second faces is located between the first face and each of the two corners;

the rear side of the pawl member is provided with two first abutting portions;

the cavity is arranged between the two first abutting portions;

the pawl member is provided with a limit channel connected to the cavity;

the limit channel faces the second abutting face;

the limit channel has a depth greater than that of the cavity;

a limit face is formed between the cavity and the limit channel;

the limit face has a planar shape;

the direction control unit is pivotally mounted in the third receiving recess, and is rotated to move the pawl member in the second receiving recess;

the direction control unit includes a rotation member, a push member, and an elastic member;

the rotation member is pivotally mounted in the third receiving recess, and has a first end provided with a cylindrical block and a second end provided with a second pivot portion;

the cylindrical block extends into the depression, and has a surface flush with the end face;

the cylindrical block is provided with a drive knob arranged between the first resting face and the second resting face and movable to rest on one of the first resting face and the second resting face;

the second pivot portion is pivotally mounted on the first pivot portion;

the rotation member is provided with two second abutting portions abutting the two first abutting portions and the two corners respectively;

the rotation member is provided with a receiving chamber having a rectangular shape;

the receiving chamber has a bottom provided with a projection extending into the second receiving recess;

when the rotation member is moved to a position, the projection is received in the limit channel and restricted by the limit face;

the projection has a width greater than that of the receiving chamber and is provided with two third abutting portions abutting a wall of the second receiving recess;

the push member has a cuboid shape;

the push member is partially received in the receiving chamber and has a first end provided with a push face and a second end provided with a receiving space;

the push face is received in the cavity and has a single arcuate shape with a diameter equal to that of each of the two second faces;

the push face is moved to press one of the two second faces, and the pawl member is moved in the second receiving recess;

when the push face rests on one of the two second faces, the push member is restricted by one of the two corners;

the elastic member is received in the receiving chamber and the receiving space, and biased between the rotation member and the push member;

the push member partially extends into the second receiving recess, and is restricted by the first abutting face;

the push member restricts the rotation member;

when the pawl member rests on a peripheral wall of the second receiving recess, one of the two first abutting portions restricts one of the two second abutting portions;

when the pawl member is located at a middle position of the second receiving recess, the two corners restrict the two second abutting portions;

the retaining ring is mounted in the first annular groove and the second annular groove; and the projection is partially received in the receiving chamber and partially protrudes from the receiving chamber.

8. The ratchet wrench as claimed in claim 1, wherein each of the two second abutting portions rests on a bottom of one of the two first abutting portions and a bottom of one of the two corners respectively.

9. The ratchet wrench as claimed in claim 1, wherein when the rotation member is rotated and moved to a position where the pawl member is located at a middle position of the second receiving recess, the two ends of the pawl member are spaced from the peripheral wall of the second receiving recess, a bottom of each of the two corners rests on each of the two second abutting portions, the projection rests on the limit face, and the push face presses the first face.

* * * * *